US008047333B2

(12) United States Patent
Finschi

(10) Patent No.: US 8,047,333 B2
(45) Date of Patent: Nov. 1, 2011

(54) METHOD AND ELEVATOR INSTALLATION FOR USER SELECTION OF AN ELEVATOR

(75) Inventor: Lukas Finschi, Luzern (CH)

(73) Assignee: Inventio AG, Hergiswil NW (CH)

( * ) Notice: Subject to any disclaimer, the term of this patent is extended or adjusted under 35 U.S.C. 154(b) by 700 days.

(21) Appl. No.: 11/997,835

(22) PCT Filed: Jul. 24, 2006

(86) PCT No.: PCT/CH2006/000386
§ 371 (c)(1),
(2), (4) Date: Feb. 4, 2008

(87) PCT Pub. No.: WO2007/014477
PCT Pub. Date: Feb. 8, 2007

(65) Prior Publication Data

US 2008/0236956 A1 Oct. 2, 2008

(30) Foreign Application Priority Data

Aug. 4, 2005 (EP) ..... 05107185

(51) Int. Cl.
*B66B 1/18* (2006.01)

(52) U.S. Cl. ..... 187/382; 187/388; 187/391; 187/396

(58) Field of Classification Search ..... 187/247, 187/380–388, 391, 393, 396–399
See application file for complete search history.

(56) References Cited

U.S. PATENT DOCUMENTS 4,411,337 A 10/1983 Schroder et al.
4,711,324 A 12/1987 Schroder
4,718,520 A 1/1988 Schroder
4,735,294 A 4/1988 Schroder
4,836,336 A 6/1989 Schroder
4,869,348 A 9/1989 Schroder
4,878,562 A 11/1989 Schroder
4,926,976 A 5/1990 Schroder
(Continued)

FOREIGN PATENT DOCUMENTS

CA 2121012 C 11/1994
(Continued)

OTHER PUBLICATIONS

Mulvaney et al., "Dynamische Echtzeit-Abfolgesteuerung und ihre Anwendung bei Aufzugsanlagen", Lift-Report 29, Year 2003, pp. 18-23, Issue 1, Germany.

(Continued)

*Primary Examiner* — Jonathan Salata
(74) *Attorney, Agent, or Firm* — Fraser Clemens Martin & Miller LLC; William J. Clemens

(57) ABSTRACT

A method for allocation of a user to a elevator installation, which is provided with a plurality of elevator cars and with a destination call control unit, wherein the user lodges a destination call at the destination control unit using a communications unit. The destination call control unit determines a group of elevator cars for serving the destination call and makes the group known to the user by the communications unit. The user selects an elevator car from the group by the communications unit. In addition, information for guiding the user to the selected elevator car is communicated to the user by the communications unit.

34 Claims, 4 Drawing Sheets

U.S. PATENT DOCUMENTS

| | | | | |
|---|---|---|---|---|
| 4,930,603 | A | 6/1990 | Brenner | |
| 4,939,634 | A | 7/1990 | Schroder | |
| 4,979,594 | A | 12/1990 | Begle et al. | |
| 4,989,694 | A | 2/1991 | Ueshima et al. | |
| 4,991,694 | A | 2/1991 | Friedli | |
| 4,993,518 | A | 2/1991 | van Straaten et al. | |
| 5,056,628 | A | 10/1991 | Aime | |
| 5,065,846 | A | 11/1991 | Schroder | |
| 5,092,431 | A | 3/1992 | Schroder | |
| 5,192,836 | A | 3/1993 | Schroder | |
| 5,252,790 | A | 10/1993 | Aime | |
| 5,300,738 | A | 4/1994 | Kostka et al. | |
| 5,305,194 | A | 4/1994 | MacDonald | |
| 5,305,198 | A | 4/1994 | Schroder et al. | |
| 5,307,903 | A | 5/1994 | Morita et al. | |
| 5,382,761 | A | 1/1995 | Amano | |
| 5,612,519 | A | 3/1997 | Chenais | |
| 5,689,094 | A | 11/1997 | Friedli et al. | |
| 5,749,443 | A | 5/1998 | Romao | |
| 6,011,839 | A | 1/2000 | Friedli et al. | |
| 6,062,346 | A | 5/2000 | Friedli et al. | |
| 6,065,570 | A | 5/2000 | Friedli et al. | |
| 6,223,160 | B1 * | 4/2001 | Kostka et al. | 704/275 |
| 6,315,083 | B1 | 11/2001 | Schuster et al. | |
| 6,382,363 | B1 * | 5/2002 | Friedli | 187/384 |
| 6,401,874 | B2 | 6/2002 | Siikonen | |
| 6,481,536 | B2 | 11/2002 | Pfeffer | |
| 6,801,792 | B1 * | 10/2004 | Schuster et al. | 455/566 |
| 6,935,465 | B2 | 8/2005 | Friedli | |
| 6,986,408 | B2 * | 1/2006 | Takeuchi | 187/380 |
| 7,036,635 | B2 * | 5/2006 | Rintala et al. | 187/396 |
| 7,353,915 | B2 * | 4/2008 | Zaharia et al. | 187/388 |
| 7,377,364 | B2 * | 5/2008 | Tyni et al. | 187/380 |
| 7,610,995 | B2 * | 11/2009 | Ylinen et al. | 187/382 |
| 7,766,129 | B2 * | 8/2010 | Makela et al. | 187/396 |
| 7,886,336 | B2 | 2/2011 | Schuster et al. | |
| 7,936,249 | B2 | 5/2011 | Friedli | |
| 2002/0023804 | A1 | 2/2002 | Pfeffer | |
| 2003/0159890 | A1 | 8/2003 | Schuster et al. | |
| 2004/0262093 | A1 | 12/2004 | Forsythe et al. | |
| 2009/0133968 | A1 * | 5/2009 | Smith et al. | 187/382 |

FOREIGN PATENT DOCUMENTS

| | | | |
|---|---|---|---|
| CN | 1439592 | A | 9/2003 |
| EP | 0 427 992 | A2 | 5/1991 |
| EP | 0 427 992 | A3 | 5/1991 |
| EP | 0 427 992 | B1 | 5/1991 |
| EP | 1 041 032 | A2 | 10/2000 |
| EP | 1 041 032 | B1 | 10/2000 |
| EP | 1110899 | A1 | 6/2001 |

OTHER PUBLICATIONS

Fortune, James W., "Electronic Up-Peak Booster Options", Elevator World, Nov. 2003, pp. 97-101, U.S.

Hikita et al., "Steuerung für Aufzugsgruppen mit künstlicher Intelligenz", Lift-Report 28, Year 2002, pp. 53-56, Issue 4, Germany.

* cited by examiner

LEGEND

| | | |
|---|---|---|
| 10 – User | 20 – Elevator Installation | 21 – First Elevator Car |
| 22 – Second Elevator Car | 24 – First Floor | 25 – Second Floor |
| 26 – Third Floor | 30 – Mobile Telephone | 40 – Destination Call Terminal |

METHOD AND ELEVATOR INSTALLATION FOR USER SELECTION OF AN ELEVATOR

FIELD OF THE INVENTION

The invention relates to a method of allocating a user to an elevator installation with a plurality of elevators and with a destination call control unit.

BACKGROUND OF THE INVENTION

By plurality of elevators in the sense of the present invention there is to be understood, in particular, a plurality of elevator cars, wherein the elevator cars can run in one elevator shaft and/or adjacent to one another and/or one above the other in several elevator shafts.

U.S. Pat. No. 4,989,694 A discloses an elevator installation in which a group control selects an elevator for each floor call actuated at a floor terminal and displays all status data on a floor display device to the user activating the floor call. For example, the elevator is selected which serves the floor in the shortest time and also the filling state and possible travel restrictions of the elevator are displayed. If the user is in agreement with the selection, he or she does not have to do anything further and can board the elevator car. In the elevator car the user must then actuate a car call in order to inform the group control about the travel destination of the user. If, however, the user is not in agreement with the selection then he or she can, through actuation of a button of the floor terminal, deselect the elevator displayed on the floor display device, whereupon the group control selects and displays another elevator.

A method for communication with a transport system is known from EP 1 041 032 A1, in which the user makes known his or her travel destination already at the boarding floor to a destination call control unit. The one-step destination call control is substantially more efficient than the two-step floor call, car call control. Since the destination call control unit knows the travel destination of the user already on actuation of the destination call the unit can calculate more than merely the elevator car most quickly serving the boarding floor; rather, it effectively determines the elevator car transporting the user most quickly to the travel destination. In addition, the user after boarding the elevator car no longer has to activate a further car call. The transport system of EP 1 041 032 A1 can be, for example, an elevator installation with at least one elevator shaft in which several elevator cars run with a high degree of autonomy. Provided as a communications unit is, for example, a touch-screen display device on which several travel destinations are displayed. The user selects his or her travel destination by contacting the touch-screen and thereupon obtains, displayed on the display device, information about which elevator car at which boarding location is to be boarded in order to get to his or her travel destination.

The user now has no influence on the elevator car determined by the destination call control unit by way of program and is at the mercy of the predetermined allocation algorithm.

SUMMARY OF THE INVENTION

The present invention has an object of creating a method for allocation of a user to an elevator, which enables individual adaptation to the needs of the user.

For fulfillment of this object it is provided in accordance with the invention, in the case of a method of allocating a user to an elevator installation with a plurality of elevator cars and with a destination call control unit, that comprises the following steps:

a) lodging a destination call at the destination call control unit by the user by means of a communications unit;
b) determining a group of elevator cars for serving the destination call by the destination call control unit;
c) making the group of elevator cars known to the user by means of the communications unit;
d) selecting an elevator car from the group of elevator cars by the user by means of the communications unit; and
e) communicating information to the user for guidance of the user to the selected elevator car by means of the communications unit.

The method is based on the recognition that the user can interactively select a specific elevator car from a group of elevator cars determined by the destination call control unit. This makes it possible for the user to be able to select that elevator car best corresponding with his or her individual needs and to be preferred from his or her viewpoint for the respective situation.

The method thus makes it possible for the user to be able to make, by way of the communications unit preferably carried by the user, an own selection of a elevator car preferred by him or her and thus not to have elevator cars determined in computerized manner by the destination call control from purely logistical and economic standpoints.

For example, the personnel of a building can show a visitor the building and then through selection of a best-equipped elevator car move the visitor by the elevator car in the building in order to leave a best-possible impression on the visitor. In another case, several passengers can agree with one other, for example by means of several communications units, that they select a specific elevator car in each instance by way of the communications unit which is carried and use this elevator car together.

In the case of an advantageous development of the method it is provided that a mobile communications means, preferably a mobile telephone, carried by the user is used as communications unit. It is thus possible to avoid the user being obliged to carry, apart from his or her mobile telephone, a further mobile communications unit. Alternatively the communications unit can also be formed by at least one fixed-position destination call terminal located on a floor of the building. The selection can then be carried out by means of a screen, for example by a touch-screen, and/or by a keyboard of the destination call terminal.

Advantageously, in step c) at least one of the elevator cars from the group of elevator cars is recommended by the destination call control unit. In this manner the user can be informed which elevator car is to be preferred for, for example, transport in an advantageous manner and as fast as possible to the destination floor.

In addition, a preferred development of the method is proposed in which the user selects one of several elevator cars arranged one above the other in a common elevator shaft. For example, in the case of multi-deck elevators often only one of the elevator cars of the multi-deck elevator serves the floor in which the user is located. If boarding at another boarding floor is more advantageous for the user in order to reach his or her travel destination in the shortest possible time then in step c) this advantageous elevator car is made known by the elevator control unit and such a change of the boarding floor recommended. For example, the user is informed by the destination call control unit to use a moving walkway in order to change to the boarding floor from which the favored elevator car departs.

In order to facilitate selection of an elevator car from the group of elevator cars for a user who, for example, is still not confident of the infrastructure of a building it is of advantage if in step c) a restricted number of elevator cars is made known. Thus, if the user is located at the main entrance of the building there is made known, of the determined elevator cars, only those which are located in the region of the main entrance of the building or which in any event serve the main entrance of the building. For example, in the case of elevators with several elevator cars travelling one above the other in an elevator shaft often only one of these elevator cars serves the main entrance of the building. This elevator car does not necessarily have to be the most favorable for going to the travel destination in the shortest time. Nevertheless, it is advantageous for the user not confident with the infrastructure of the building to display this less advantageous elevator car to him or her even if another elevator car of the multi-deck elevator would be more favorable for going to the travel destination in simple manner.

Moreover, it is of advantage if together with making known the group of elevator cars to the user and/or together with communication of information to the user for guidance of the user to the selected elevator car there are made known further data, for example the current position of the selected elevator car and/or the waiting time until the selected elevator car has arrived at the boarding location and/or the anticipated travel time from the boarding location to the destination floor and/or, however, also building-specific information and/or information about specific events within this building. Thus, it is possible to display to the user in the case of an elevator installation with several elevator shafts not only the boarding location, i.e. the actual elevator shaft in which the elevator car selected by him or her runs, but—additionally or alternatively—which of the elevator cars running at the boarding location is the selected elevator car.

In order to selectively inform the destination control unit about user-specific conditions it is additionally of advantage if in step a) data, preferably a personal identification code, are communicated by the user to the destination call control unit. These data can be input by the mobile communications unit and/or by way of the stationary destination call terminal and communicated from there to the destination call control unit. However, these data can also be stored in a user profile of the destination call control unit and called up there by way of the personal identification code. Thus, for example, a previously generated personal identification code can be linked with specific transport conditions or a series of preferred elevator cars. In addition, it is thus possible to inform the destination call control unit about a handicap of the user. The destination call control unit then determines in step b) a particularly suitable elevator car for a user with only limited capability of movement or capability of transport due to a handicap. Such an elevator car, for example, travels particularly gently and also brakes in correspondingly gentle manner. In addition, such an elevator car can enter and stop particularly precisely at the floors so that users unable to walk properly are not able to trip over edges during boarding and departing the elevator car.

In an advantageous development of the method it is provided that an access authorization of the user to the elevator installation is checked and the elevator cars are determined only if the check of the access authorization is successful. For example, the user is obliged to communicate a personal identification code to the destination call control unit and this code is compared with a stored code reference. In addition, this check of access authorization can be supplemented with an authentication of the user, i.e. the user must additionally authenticate himself or herself in that, for example, an iris scan or fingerprinting of the user is carried out and the detected biometric data are communicated to the destination call control unit and compared with stored reference data. The reference code advantageously uniquely associated with the personal identification code and the reference data similarly advantageously associated with the detectable biometric data are advantageously stored in a user profile of the destination call control unit. The iris scan or the fingerprinting can be carried out either in the region of the boarding location or in the elevator car. In the case of an unsuccessful identification of the person the user can be denied access to the elevator installation or the user can, in the case of unsuccessful authentication, be secured in an elevator car. It is ensured by these measures that the user can use only the elevator car assigned to a specific access authorization. With knowledge of the present use can be made of other biometric methods for authentication of a user.

In an advantageous development of the method the user is authorized to select an elevator car only at specific points in time or within a specific time period. In this manner it is possible to prevent, at peak times with a multiplicity of users to be transported, the average journey time of the individual user is prolonged due to selection of an elevator car disadvantageous for the overall operation of the elevator installation. Restriction of the selection can relate alternatively or in combination also to specific elevators, elevator cars, boarding locations and/or floors. This restriction of selection is advantageously also stored in a user profile of the destination call control unit.

According to a preferred development of the method it is provided that step a), step c) and/or step d) is or are carried out only when the communications unit is located in a near field within a specific range of the elevator installation. The Bluetooth standard is particularly suitable for carrying out this near-field communication. An additional safety measure can be created by the near-field communication for the case that safety-relevant data, such as, for example, access codes, are communicated. The range preferably amounts to less than approximately 10 meters.

In addition, a preferred development of the method is provided in which, in the selection of an elevator car by the user carried out in step d), reservation of the selected elevator car for preferred travel to a destination floor takes place and/or reservation of the selected elevator car for a cleaning or maintenance mode takes place. This reservation is preferably restricted in time. Preferably, the reserve elevator car is removed from the group of elevator cars and is thus unavailable to other users.

In a further preferred development of the invention it is provided that the communication, which is proposed in step e), of information to the user consists of a call acknowledgement.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
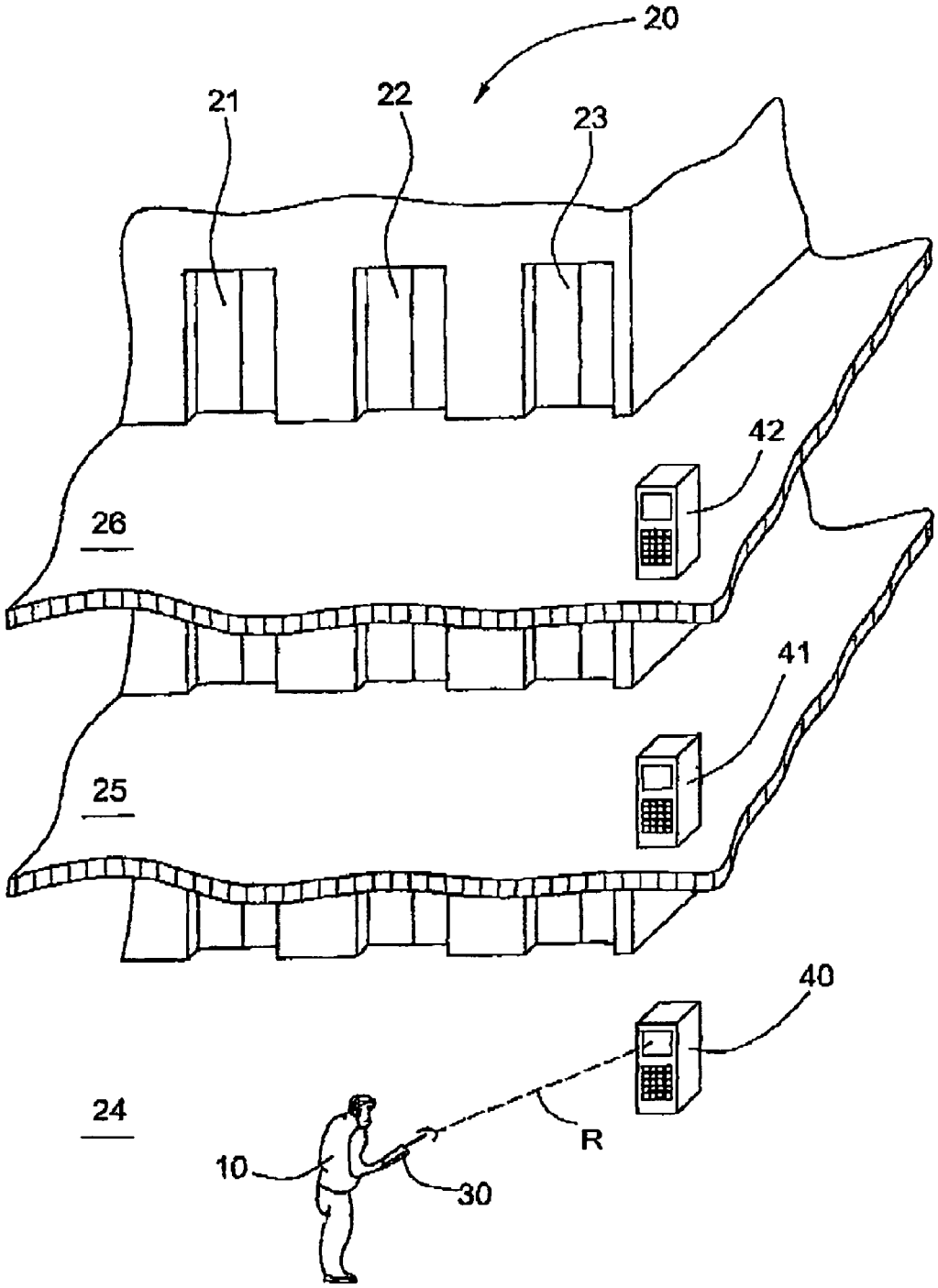
FIG. 1 shows, schematically, a detail of a first embodiment of the present invention by way of example of an elevator installation with several elevator cars running adjacent to one another in elevator shafts of a building.
Figure 2:
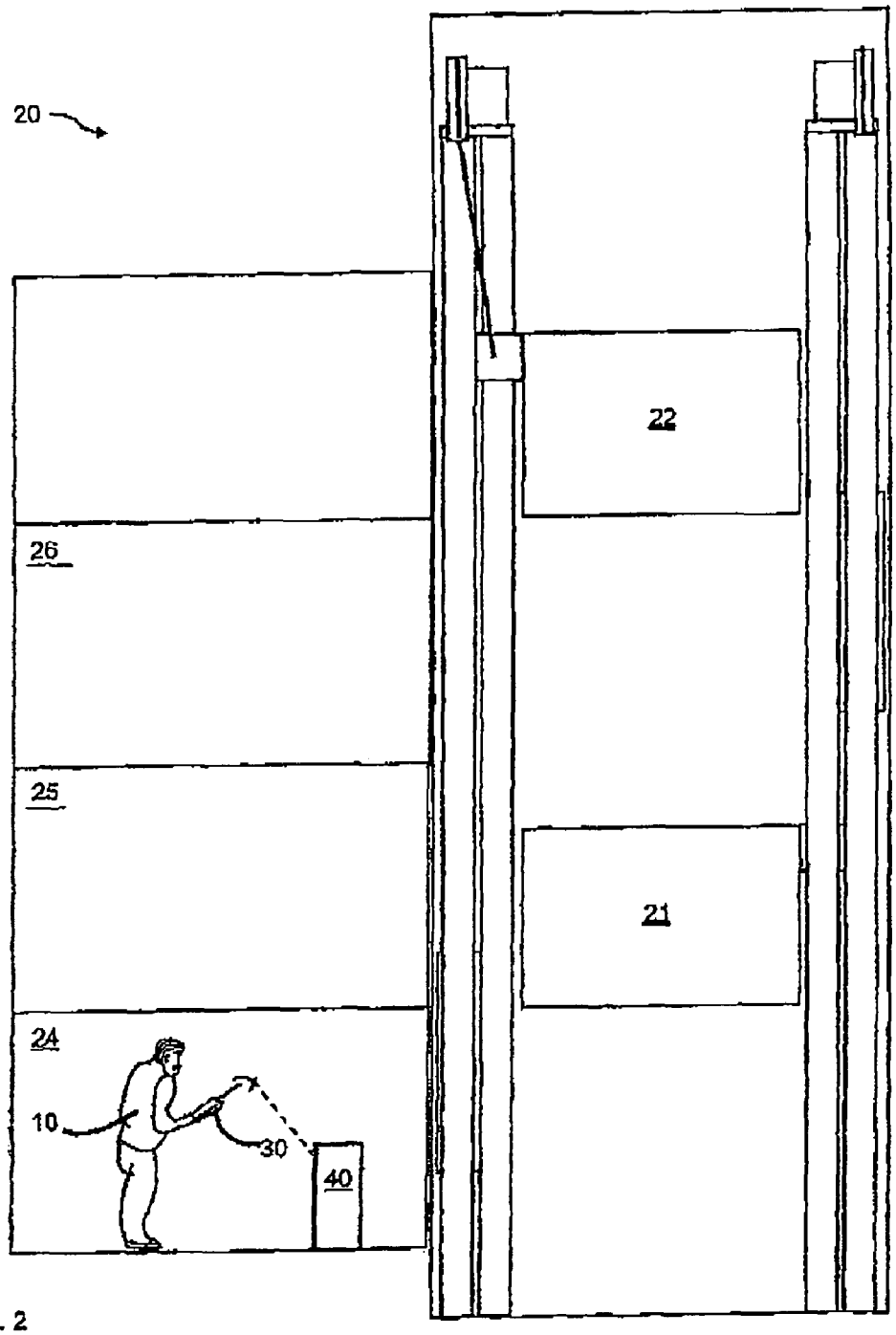
FIG. 2 shows, schematically, a detail of a further embodiment of the present invention by way of example of an elevator installation with several elevator cars running adjacent to one another in elevator shafts of a building.

FIG. 1 shows schematically a form of embodiment of an elevator installation 20 of a building with three elevator shafts disposed adjacent to one another, wherein a first elevator car 21, a second elevator car 22 and a third elevator car 23 travel independently of one another in each elevator shaft. According to the form of embodiment in accordance with FIG. 2 several elevator cars 21, 22 can, however, also be arranged one above the other and travel independently of one another in a single elevator shaft. Obviously, a combination of elevator cars travelling adjacent to one another and elevator cars travelling one above the other in elevator shafts is also possible. Moreover, it is also possible for a multi-deck elevator, which has several elevator cars arranged one above the other and travelling in common, to travel in one elevator shaft.

The detail of the building illustrated in FIG. 1 shows a first floor 24, a second floor 25 and a third floor 26, wherein in each floor 24, 25, 26 a respective floor door as boarding location leads to one of the elevator cars 21, 22, 23. In addition, a respective fixed-position destination call terminal 40, 41, 42 is provided on each of the floors 24, 25, 26 in the region of the elevator installation 20. The destination call terminals 40, 41, 42 are each equipped with a control panel and a display device and are connected by way of a data line with a central destination call control unit.

A method for allocation of a user 10 to the elevator installation 20 is explained in the following on the basis of this system. After the user 10 has entered the building at the first floor 24 the user 10 approaches the elevator installation 20. As soon as the user 10 is in the vicinity, i.e. in a range R of less than approximately 10 meters, from the destination call terminal 40 the user 10 lodges a destination call at the destination call control unit by means of a mobile telephone 30, which forms a communications unit, carried by the user. Lodging of this destination call can take place automatically or by an appropriate button and/or speech input. The destination call comprises details of the desired destination floor and/or desired destination location and is transmitted to the destination call terminal 40 by radio link with use of the Bluetooth standard by way of a near-field communication.

After the destination call terminal 40 has received the destination call the destination call terminal 40 transmits the received data to the destination call control unit. On the basis of these data the destination call control unit now determines a group of elevator cars 21, 22 for serving the destination call lodged by the user 10.

In the following it is assumed by way of example that the user 10 desires transport to the third floor 26 as destination floor. The computer unit of the destination call control unit thereupon determines a group of elevator cars 21, 22 for servicing the destination call, wherein the elevator car 22 is computed to be the fastest possible variant for transport from the first floor 24 to the third floor 26. The elevator cars 21, 22 determined by the destination call control unit are then communicated, as group of elevator cars for servicing the destination call, to the mobile telephone 30 again by means of the near-field communications network. The determined elevator cars 21, 22 are displayed on a display device of the mobile telephone 30, wherein the elevator car 22 is marked as fastest possible variant. The user 10 thereupon selects by means of the control panel of the mobile telephone 30 one of the elevator cars a detail of a further form of embodiment by way of example of a elevator installation, 22, for example the elevator car 21, and informs the destination control unit of the selection made by communication of a corresponding signal by way of the near-field radio communication.

After selection of the elevator car 21 and localization of the whereabouts of the mobile telephone 30 as a consequence of the establishing of contact between the destination call terminal 40 and the mobile telephone 30 the destination call control unit determines a travel description for guidance of the user 10 from the current location to the boarding location of the selected elevator car 21 and communicates these data to the mobile telephone 30 by way of the destination call terminal 40. The user 10 can then read off from the display device of the mobile telephone 30 the communicated data for guidance to the boarding location of the selected elevator car 21 and find the boarding location. This proves particularly useful if the selected elevator car 21 is located in a part of the building remote from the instantaneous position.

The afore-described method enables communication of information to the user in the form of a call acknowledgement.

The afore-described method is particularly distinguished by the fact that the user 10 is interactively incorporated into the allocation to the elevator installation 20 and the selection of the elevator car 21 provided for transport and in this manner can adapt the transport process to his or her individual requirements.

In addition, the afore-described method makes it possible for the user to reserve a selected elevator car. The reservation consists of, for example, a preferential trip to a destination floor in which solely the user or a pre-defined group of users will travel in the selected, reserved elevator car. Thus, in a building in which employees of several firms use the group of elevators, a selected elevator car can be reserved for the employees of a specific firm. As long as an employee of a pre-defined group has reserved a selected elevator car the other employees, which activate a destination call, of the group are informed about the fact that a selected elevator car is reserved for them. The criteria for reservation are freely definable. Thus, an elevator car can be reserved only for a group of employees as VIP (Very Important Person) users. In addition, the reservation consists of, for example, a special cleaning or maintenance mode of the selected elevator car. A cleaning specialist reserves the selected elevator car as user for, for example, a cleaning mode in which the elevator car with doors kept open is not moved out of the floor. A maintenance engineer reserves the selected elevator car as user for, for example, a maintenance mode in which the selected elevator car travels only at restricted speed and is not available to other users. This reservation is preferably restricted in terms of time. For this purpose the reserved elevator car is removed by the destination call control unit from the group of elevator cars and made unavailable to the other users for at least a time.

Figure 3:
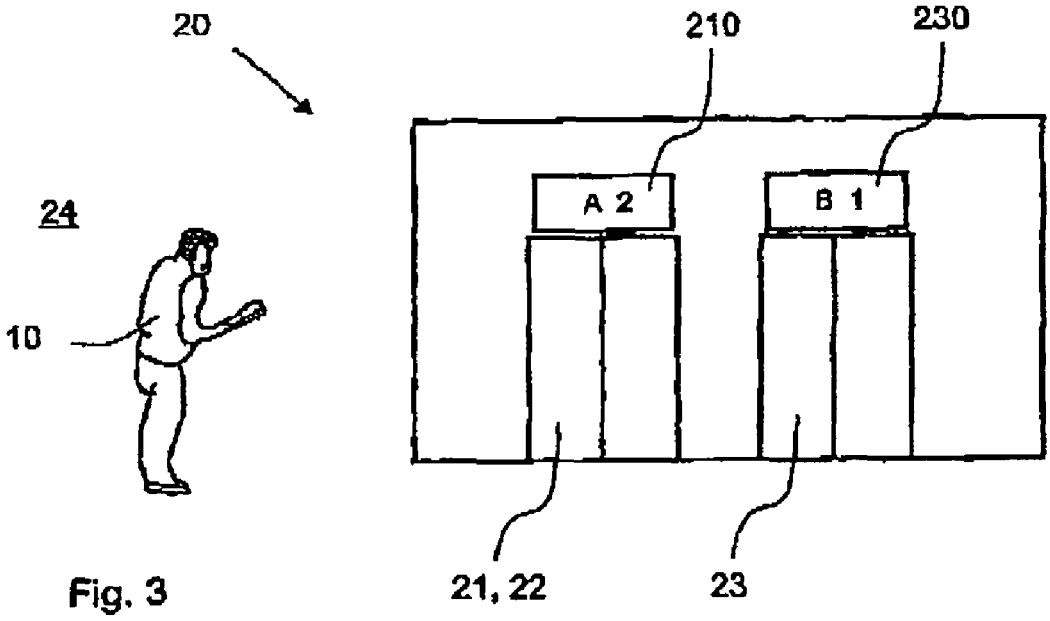
FIG. 3 shows, schematically, a detail of another embodiment by way of example of an elevator installation with several allocation display devices of the elevator cars running in several elevator shafts of a building.

In the form of embodiment according to FIG. 3 the elevator installation comprises several stationary allocation display devices 210, 230 of the elevator cars 21, 22, 23 travelling in several elevator shafts of a building. The allocation display devices 210, 230 are readily visible at the boarding location, i.e. arranged above the doors to the elevator shafts. The elevator cars 21, 22, 23 allocated to the users are displayed to the user 10 located on the floor 24. The allocations are carried out, for example, alpha-numerically in the manner that the boarding location is denoted by "A", "B", "C", . . . and the elevator cars by numerals "1", "2", "3", . . . . Accordingly, "A2" denotes the "2"nd elevator car in the elevator shaft "A" and "B1" denotes the "1"st elevator car in the elevator shaft "B". The allocations can obviously also be displayed to the user 10 on the display device of his or her mobile communications means 30. In this manner the user 10 obtains, by way of his or her mobile communications means 30, information in the form of an allocation where he or she can board the selected elevator car 21. He or she then recognizes this allocation again at the allocation display devices 210, 230 and is thus guided simply and safely to the boarding location.

Figure 4:
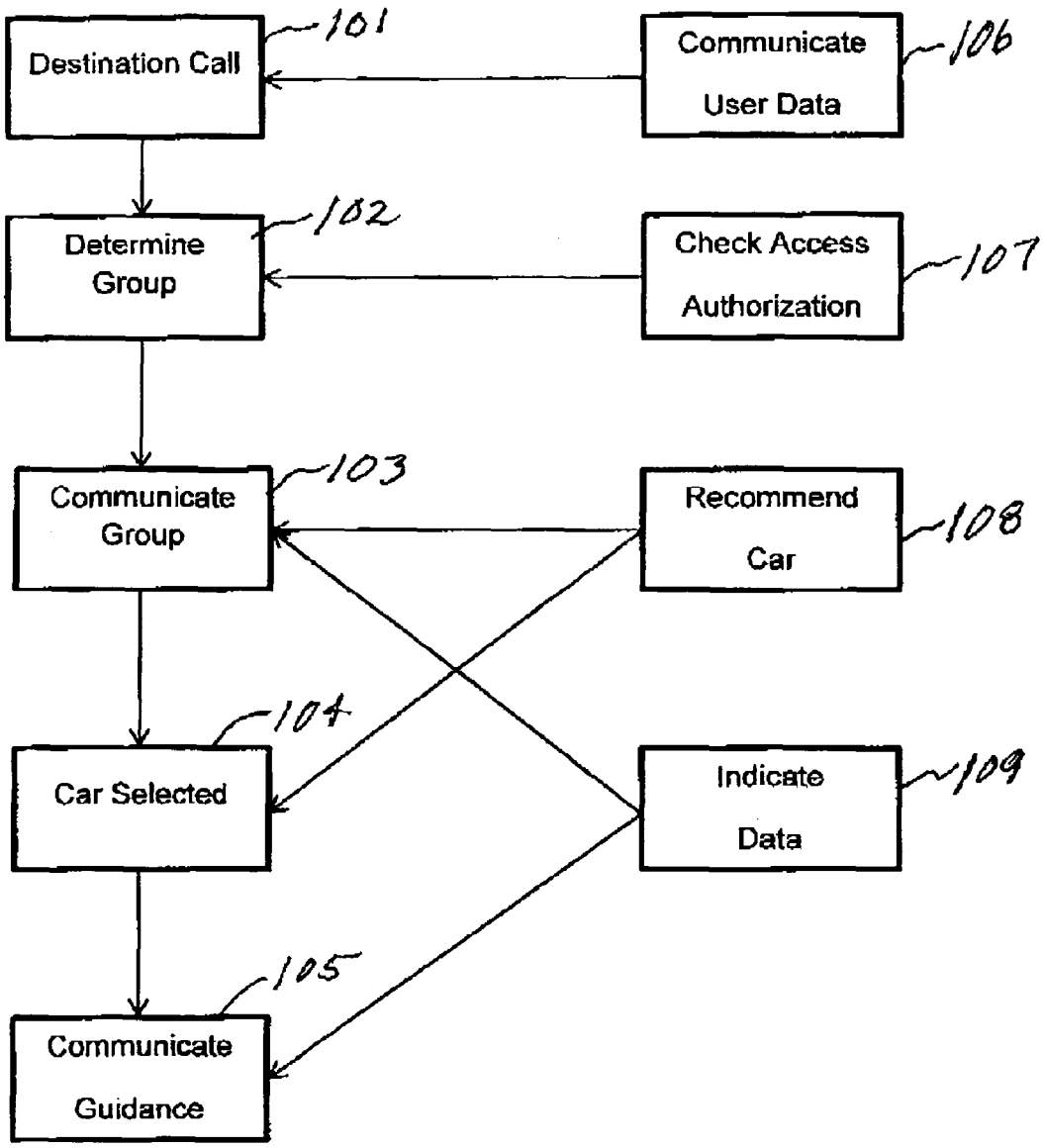
FIG. 4 is a flow diagram of the method according to the present invention.

FIG. 4 is a flow diagram of the method of allocating a user to an elevator installation with a plurality of elevator cars and with a destination call control unit, that comprises the following steps: a) lodging a destination call at the destination call control unit by the user by means of a communications unit (step 101); b) determining a group of elevator cars for serving the destination call by the destination call control unit (step 102); c) making the group of elevator cars known to the user by means of the communications unit (step 103); d) selecting an elevator car from the group of elevator cars by the user by means of the communications unit (step 104); and e) communicating information to the user for guidance of the user to the selected elevator car by means of the communications unit (step 105). The user communicates the user data to the call control unit in a step 106. Access authorization of the user to the elevator installation is checked in a step 107. A more advantageous car for the user in order to reach his or her travel destination in the shortest possible time is made known by the elevator control unit and recommended in a step 108. It is of advantage if together with making known the group of elevator cars to the user and/or together with communication of information to the user for guidance of the user to the selected elevator car there are made known further data, for example the current position of the selected elevator car and/or the waiting time until the selected elevator car has arrived at the boarding location and/or the anticipated travel time from the boarding location to the destination floor and/or, however, also building-specific information and/or information about specific events within this building in a step 109.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for allocating a user at an elevator installation with a plurality of elevator cars and with a destination call control unit, wherein the method comprises the following steps:

a) lodging at the destination call control unit a destination call received from a user communications unit;

b) determining a group of elevator cars for serving the destination call by the destination call control unit;

c) indicating the group of elevator cars to the user communications unit;

d) receiving a selection of a specific elevator car from the group of elevator cars from the user communications unit; and e) communicating to the user communications unit information for guidance of the user to the selected specific elevator car.

2. The method according to claim 1 wherein a mobile communications means able to be carried by the user is used as the user communications unit.

3. The method according to claim 2 wherein the mobile communications means is a mobile telephone.

4. The method according to claim 1 wherein at least one stationary destination call terminal is located on a floor of the building and is used as the user communications unit.

5. The method according to claim 1 wherein in step c) at least one of the elevator cars from the group of elevator cars is recommended by the destination call control unit.

6. The method according to claim 5 wherein if an elevator car advantageous for the user is departing from another boarding floor this advantageous elevator car is indicated in the group of elevator cars in step c).

7. The method according to claim 5 wherein in step d) the selected elevator car is one of several elevator cars arranged one above the other in a common elevator shaft.

8. The method according to claim 1 wherein in step c) a restricted number of elevator cars is indicated.

9. The method according to claim 8 wherein if the user communications unit is on a floor which is served by at least one less advantageous elevator car then only this less advantageous elevator car is indicated in step c).

10. The method according to claim 1 wherein in step c) or in step e) data are made known to the user communications unit, the data including at least one of a current position of the selected elevator car, a waiting time until the selected elevator car has arrived at a boarding location, an anticipated travel time from the boarding location to a destination floor, building-specific information, and information about events within the building.

11. The method according claim 10 wherein at least one of a boarding location of the selected elevator car and details about which of the elevator cars is running to the boarding location is the selected elevator car is indicated to the user communications unit.

12. The method according to claim 11 wherein the boarding location of the selected elevator car and details about which of the elevator cars is running to the boarding location of the selected elevator car are indicated on allocation display devices at the boarding location.

13. The method according to claim 1 wherein in step a) data including a personal identification code of the user are received by the destination control unit.

14. The method according to claim 13 wherein in step a) data are communicated about a user handicap and in step b) the group of elevator cars comprises an elevator car suitable for the user handicap.

15. The method according to claim 13 wherein an access authorization of the user to the elevator installation is checked and the group of elevator cars is determined as a result of the check of the access authorization.

16. The method according to claim 15 wherein for checking the access authorization of the user the personal identification code is compared with a reference code.

17. The method according to claim 15 wherein the check of the access authorization of the user is supplemented by an authentication of the user.

18. The method according to claim 17 wherein the user is authenticated by detection of biometric data of the user including at least one of an iris scan and a fingerprint.

19. The method according to claim 18 wherein the biometric data detected from the user are communicated to the destination call control and compared with stored reference data.

20. The method according to claim 16 wherein at least one of the reference code and user reference data are stored in a user profile of the destination call control unit.

21. The method according to claim 17 wherein the biometric data of the user are detected either in a region of a boarding location or in an elevator car boarded by the user.

22. The method according to claim 1 wherein the selection of the elevator car is received only at specific points in time or within a specific time period.

23. The method according to claim 1 wherein in step d) a selected elevator car for a preferential travel to a destination floor is reserved or selected elevator car for a cleaning or maintenance mode is reserved.

24. The method according to claim 23 wherein in the cleaning mode doors and the car of the selected elevator car are not moved or wherein in the maintenance mode the selected elevator car is moved only at restricted speed.

25. The method according to claim 23 wherein an elevator car is reserved for a limited time or wherein an elevator car is removed from the group of elevator cars and made unavailable to other users.

26. The method according to claim 1 further comprising communicating a call acknowledgement to the user communications unit.

27. The method according to claim 1 wherein the user communications unit is located within a specific range of the elevator installation.

28. The method according to claim 27 wherein the specific range is less than approximately 10 meters.

29. An elevator installation comprising:

a plurality of elevator cars; and a destination call control unit, the destination control unit being configured to, receive a destination call from a user communications unit, determine a group of the elevator cars for serving the destination call, indicate the group of elevator cars to the user communications unit, receive a selection of a specific elevator car from the group of elevator cars from the user communications unit, and communicate to the user communications unit information for guidance of the user to the selected specific elevator car.

30. The elevator installation according to claim 29 wherein the user communications unit is a mobile communications means able to be carried by the user.

31. The elevator installation according to claim 30 wherein the mobile communications means is a mobile telephone.

32. The elevator installation according to claim 29 wherein the user communications unit is at least one stationary destination call terminal located on a floor of the building.

33. The elevator installation according claim 29 including an allocation display device at a boarding location of the selected elevator car for indicating to the user details about which of the elevator cars running to the boarding location is the selected elevator car.

34. A mobile communications unit for allocating a user to an elevator car in an elevator installation with a plurality of elevator cars and with a destination call control unit, the mobile communications unit being configured to perform a method comprising:

communicating a destination call to the destination call control unit, the destination call control unit being configured to determine a group of elevator cars for serving the destination call;

receiving from the destination call control unit the group of elevator cars;

communicating to the destination call control unit a selected specific elevator car from the group of elevator cars; and receiving from the destination call control unit information for guidance of the user to the selected specific elevator car.

* * * * *